United States Patent [19]

Roch

[11] 3,965,721

[45] June 29, 1976

[54] ADJUSTABLE DIE HOLDER

[75] Inventor: Gerald V. Roch, Indianapolis, Ind.

[73] Assignee: Hurco Manufacturing Company, Inc., Indianapolis, Ind.

[22] Filed: Feb. 24, 1975

[21] Appl. No.: 552,193

[52] U.S. Cl. ..... 72/462; 72/389; 72/448

[51] Int. Cl.[2] ..... B21D 7/06

[58] Field of Search ..... 72/22, 386, 389, 446, 72/448, 441, 462

[56] References Cited

UNITED STATES PATENTS

| | | | |
|---|---|---|---|
| 1,694,585 | 12/1928 | Dreis | 72/448 |
| 2,199,864 | 5/1940 | Wehr | 72/448 |
| 2,456,856 | 12/1948 | Bath | 72/462 |
| 2,797,724 | 7/1957 | Walldow | 72/441 |
| 3,214,955 | 11/1965 | Voth | 72/389 |
| 3,584,497 | 6/1971 | Pohjola | 72/448 |
| 3,587,286 | 6/1971 | Fritsch | 72/448 |
| 3,844,156 | 10/1974 | Hanni | 72/389 |
| 3,874,206 | 4/1975 | Cailloux | 72/389 |

*Primary Examiner*—C. W. Lanham
*Assistant Examiner*—Gene P. Crosby
*Attorney, Agent, or Firm*—Woodard, Weikart, Emhardt & Naughton

[57] ABSTRACT

A die holder frame receivable in the die plate or bed of a press brake has a die holder bar mounted thereto supported on a plurality of adjustable wedges, the forming die itself being mounted in the die holder bar. Wedges are individually adjustable to provide a crown along the length of the die holder bar, and are adjustable as a group to provide various desired heights of the die holder bar.

21 Claims, 7 Drawing Figures

ADJUSTABLE DIE HOLDER

BACKGROUND OF THE INVENTION

1. Field of the Invention:

This invention relates generally to presses for metal working, and more particularly to lower die holders for press brakes or the like.

2. Description of the Prior Art: In the typical press brake of the mechanical type (i.e. crankshaft and connecting rod drive of ram, as distinguished from hydraulic drive of ram) the height of the lower die, or the height of the upper die (punch) in the ram, is adjusted by trial-and-error, depending upon the thickness of the stock to be bent, the shape of the die, and the tonnage limitations of the machine, for example. Where a series of bends is to be performed on a single workpiece, inconvenience is encountered when different bends to be made are of different lengths. Therefore, the die adjustment must be made to accommodate the longest bend without excessive tonnage, with typical result often being that the shortest bend is not of the desired shape or consistency from one workpiece to the next. Also, it is sometimes desirable to make a bend to an angle considerably greater than the included angle of die, but there is no provision for facilitating the inclusion of this type of bend (sometimes referred to as an "air" bend) along with a series of full depth bends in a sequence of bends in a workpiece. Therefore, mechanical press brakes do not have the versatility conferred to hydraulic press brakes by the gauging system disclosed in my U.S. Pat. No. 3,618,349, issued Nov. 9, 1971.

A further problem sometimes encountered with mechanical press brakes is the tendency of the central portion of the die or bed to deflect more than the edge portions. Efforts to solve this problem are exemplified in U.S. Pat. No. 2,199,864 to Wehr, that discloses an adjustable bolster block to compensate for deflection in the bed and/or ram of the press so that articles bent thereon will be of uniform angle from end to end, and an adjustable bolster block disclosed in U.S. Pat. No. 2,456,856 to Bath. Otherwise, the conventional practice is to insert shims where needed between the lower die and die holder to provide the needed support to offset the deflection. A recently issued patent providing means for adjusting a stop bar in the bottom of the die, but not the whole die itself, is U.S. Pat. No. 3,844,156 to Hanni and Gygli.

Accordingly, there remains the need for a solution of one or more of the aforementioned problems of mechanical press brakes and, in addition, it would be quite helpful to provide some means facilitating release of a mechanical press brake which has been overloaded during the descent of the ram, and thereupon becomes stuck.

SUMMARY OF THE INVENTION

Described briefly in a typical embodiment of the present invention, means are provided for supporting a plurality of cams and followers under a die holder, with means for adjusting the followers individually for providing any desired crown or curvature in the die to compensate for deflection of the press brake ram or bed, but also to adjust the followers as a group to change the overall height of the die. In addition, means are provided for sequentially obtaining various predetermined die heights to facilitate the making of various die height adjustments to accommodate different lengths of bend to be made in sequence on a workpiece in the die.

DESCRIPTION OF THE PREFERRED EMBODIMENT

Figures 1, 2, 3, 7:
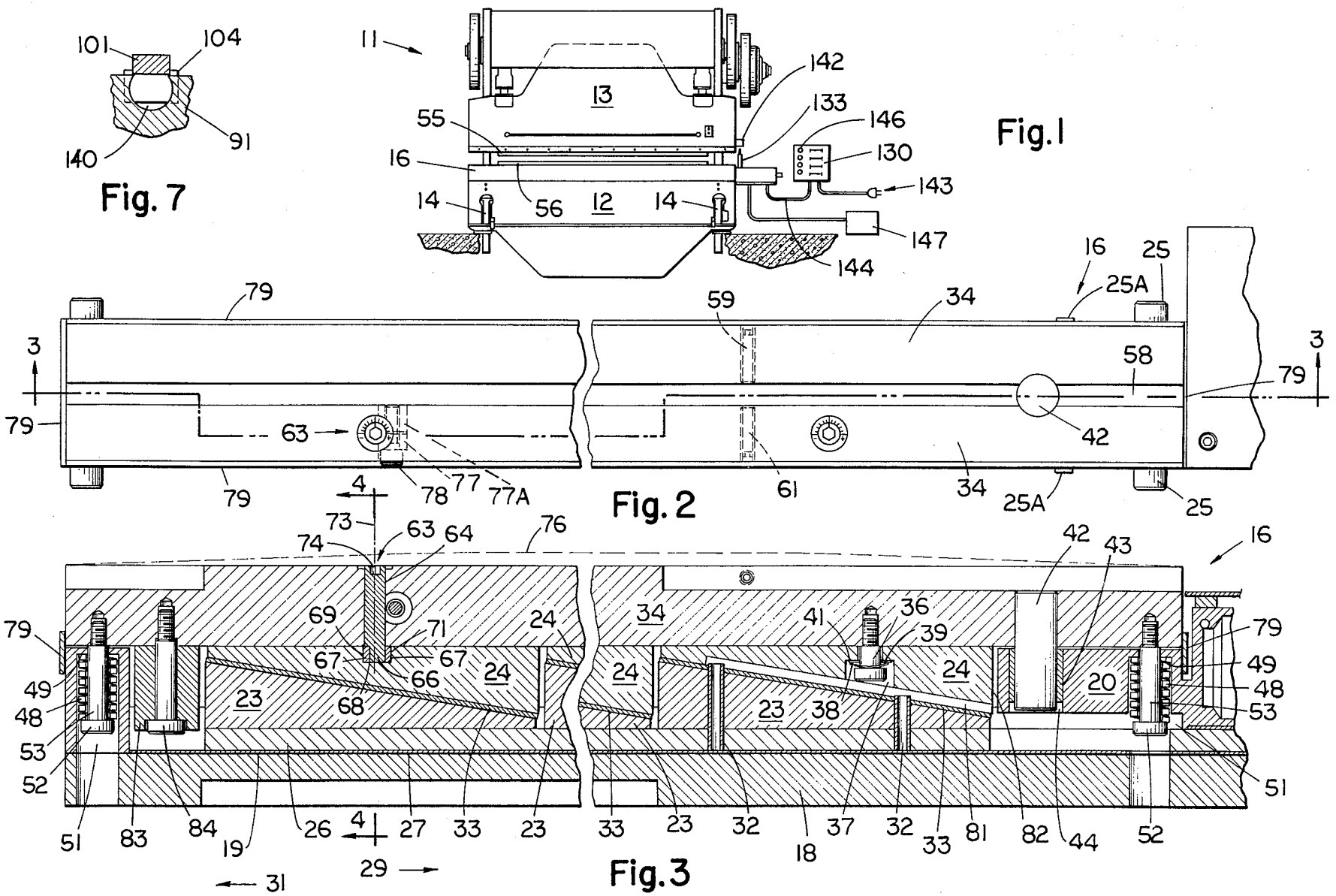
FIG. 1 is a front elevational view on a small scale, showing a press brake with a typical embodiment of the adjustable die holder of the present invention employed thereon.
FIG. 2 is a top plan view of the adjustable die holder assembly, with portions broken out to reduce the overall length and thus conserve space in the drawing.
FIG. 3 is a section taken on line 3—3 in FIG. 2, and viewed in the direction of the arrows, showing interior detail.
FIG. 7 is a section through a stop finger, taken at line 7—7 in FIG. 6 and viewed in the direction of the arrows.

Referring now to the drawings in detail, and more particularly FIG. 1, the press brake 11 includes a bed 12 and ram 13, with the bed being affixed to the side frames 14 and the ram mounted for reciprocation toward and away from the bed. The adjustable die holder assembly 16 includes a longitudinally extending key or tang 17 (FIG. 4) received in a mating slot in the bed 12, whereby the assembly is mounted to the bed and secured in place in conventional manner by the use of setscrews spaced along the length thereof.

The key 17 is at the bottom of a die holder frame 18 which is an upwardly facing channel, typically made of aluminum and extending throughout the entire length of the assembly. Low friction bearing strips 19, 21, and 22 are located on the bottom front and rear sides of the upwardly facing channel in the frame 18, these strips being typically made of a "Teflon" coated material. These serve to support a set of lower (support) wedges 23 which serve as cams, and upper wedges 24 which serve as cam followers in the channel, the lower wedges being secured to a lower wedge mounting and operating bar 26 which has its bottom surface 27 resting on the upper face of the bearing strip 19 to facilitate the movement of the bar to the right and left in the direction of arrows 29 and 31 in FIG. 3 respectively. The lower wedges are affixed to bar 26 by the use of spring-type dowel pins 32 such as are sold under the trademark "Rollpin". In addition to securing the wedge to the wedge mounting bar 26, each Rollpin also serves to locate the wedge with respect to the bar, and also locate and secure the wedge bearing plate 33 (a durable liner or facing) to the top of the wedge 23. This plate may be made of a hardened and ground chrome-plated steel secured to the wedge 23 by means of the pins 32, and also by screws or other fastening means, if desired. The wedge 23 itself, as is true of the upper wedge 24, may preferably be made of aluminum.

As is best shown in FIG. 3, the upper wedge 24 rests upon the wedge bearing plate 33 throughout substantially its entire length. In this condition, the die holder bar 34 affixed to the upper wedges, is in its lowermost position. It is affixed to the upper wedges by means of shoulder bolts 36 threadedly received in the bottom of the die holder bar 34, the head of each of these bolts being received in counterbores at 37 in the lower face of the wedge and supporting the wedge by means of a "Belville"-type spring washer 38 and flat washer 39 bearing on the underside 41 of the wedge at the counterbore 37. There is one such shoulder bolt to retain each of the wedges to the die holder 34. The longitudinal location of the die holder 34 with respect to the frame 18 is maintained by the guide pin 42 press fitted into the die holder bar and slidingly fitted into a bushing 43 press fitted into the hole 44 in the cylinder housing 20 bolted by bolts 25 and pinned by pins 25A (FIG. 2) to frame 18. In this way, when the lower wedge mounting bar 26 is pulled to the right in the direction of arrow 29 by the piston 87 in an air cylinder portion 86 of the housing 20, the wedges 23 can force the wedges 24 upwardly as the longitudinal position of the two parts 18 and 34 is maintained by the guide pin 42 as it slides upwardly in the bushing 43.

A die holder bar return spring 48 is provided adjacent each end of the die holder bar, with the upper end thereof bearing against the underside 49 of a spring pocket 51 in frame 18 at the left end and in housing 20 at the right end, adjacent each end of the bar 34. The lower end of the return spring is seated on the head 52 of the return spring mounting screw 53 threadedly received in the underside of the die holder bar 34. These springs normally urge the die holder in the downward direction so that the upper wedges are maintained in contact with the wedge support bearings 33. This is desirable when the ram is up and the lower wedge support bar 26 is shifted in the direction of arrow 31 to lower the die height.

The lower die 56 of the press brake (which matches the upper die or punch 55 on the ram, FIG. 1) has the key or tang 57 thereof received in the keyway or groove 58 of the die holder bar 34 and is secured therein by setscrews (FIG. 4) 59 and 61 which are useful to adjust the die in the front to back direction for aligning the lower die with the upper die (punch), the groove being wider than the tang, to permit this.

Figure 4:
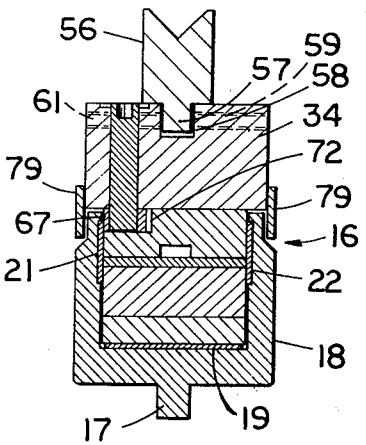
FIG. 4 is a cross-section taken at line 4—4 in FIG. 3 and viewed in the direction of the arrows, but also including the lower die.

It was mentioned above that one of the problems with the prior art has been the problem of deflection of the ram or the bed. Methods of overcoming that problem have been disclosed in the above-cited references to Wehr and Bath. However, in the present invention it is done in a different way, by providing for each of the upper wedges 24, an individual position adjustment. This is accomplished by providing for each wedge a wedge adjustment member 63 having a cylindrical body 64 received in a bore in the die holder bar 34, and having an eccentrically located cylinder 66 at its lower end. This cylinder 66 is received in a matching cylindrical hole in an eccentric bearing block, which is a rectangular or square key or bushing 67 received in a slot or keyway 68 in the top of the upper wedge. As is shown in FIG. 3, the full width of the bushing 67 across the flat surfaces 69 and 71 thereof fits the slot 68 in which it is received, but as shown in FIG. 4, there is some clearance space between the bushing and the inner wall 72 of the slot. This construction enables the shifting of the individual wedge in the direction of arrow 29 or 31 by turning the member 63 on its axis 73 by the use of an allen-type wrench, for example, in the socket 74 at the top of the member. As the member is turned, the eccentric cylinder 66 thereof can move the bushing 67 inwardly in slot 68 and to the left in the direction of arrow 31 in FIG. 3, for example, as the member is turned counterclockwise when viewed from above. One of these adjustment assemblies, including the member 63, bushing 67, and the slot in a wedge is provided for each of the upper wedges along the length of the die holder 34. In this way, by adjusting the different wedges different amounts independent of one another, a crown, or bow, can be imparted to the die holder bar 34 such as indicated by the dotted line 76, for example. If desired, a pointer on the upper end of the member 63 can be associated with scale markings on the upper face of the holder 34 as shown in FIG. 2 to indicate the location of the eccentric and the amount of vertical adjustment obtained at selected rotational positions of the member 63. Once the adjustment is accomplished, the rotational position of the member 63 can be maintained by screw operated clamp means 77, 77A, and 78, for example, as shown in FIG. 4. Clamp parts 77 and 77A float in a bore in the holder bar and each has an arcuate groove to fit the body 64 of member 63. Screw 78 is threaded in insert 77A and, when tightened, pulls the insert 77A and sleeve 77 against body 64 to clamp it. The crown established in the holder bar will offset the deflection of the bed under loads, so the net effect is a straight line at the surface of the die during the bending of the workpiece, whereby a straight bend is achieved. To exclude dirt from the wedges, dust shield or skirt members 79 are affixed to the die holder bar 34 around its perimeter.

At present it is believed preferable to have the wedges 7⅞ inches long located on 8-inch centers. If the slope thereof is 6-to-1, a ½-inch total rise of the die can be achieved by a 3-inch total stroke of the air cylinder. Various angles and materials may be selected to make the holder self-relieving when an acceptable maximum tonnage is exceeded during the stroke of the ram. The sticking of the press brake can thereby be avoided. In the event such a choice would be detrimental to other performance characteristics, the fact that the lower wedge mounting bar 26 is accessible through opening 80 in block 114 at the right-hand end, enables freeing a stuck press brake at any position other than the lowermost position of the die, by simply inserting a bar through opening 80 and abutting it against the bar 26 and striking on its right-hand end with a hammer to drive it toward the left. This will thereby permit the upper wedges to descend the ramps of the lower wedges and release the load.

As shown at 81 in FIG. 3, there is a longitudinally extending slot in the lower face of the upper wedge from the counterbore to the right-hand end 82. This is simply to provide clearance for the upper end of the dowel pin 32. Also, it will be noted that there is a guide block 83 secured by a screw 84 in the left-hand end of the die holder bar 34. This block 83 extends the full width of the space between the bearing strips 21 and 22 in FIG. 4 and thus guides the left-hand end of the die holder bar as it is moved up and down as the wedge mounting bar 26 is moved to the right and to the left, respectively.

Actuation of the bar 26 is provided by an air cylinder 86 which is shown as an integral part of the housing 20, but could also be a unit affixed to the frame by bolts or otherwise. The piston 87 thereof is connected to piston rod 88 connected by a pin 89 to the lower stop housing 91 which is connected to the bar 26 by a Rollpin 92 and screws 93. Air is supplied to the cylinder 86 from a connection 94 to a building or shop air supply, this connection being connected to a four-way valve 96. Lines 97 and 98 from this valve are connected to the spaces at the head-end and shaft-end of the piston in the cylinder 86.

Figure 5:
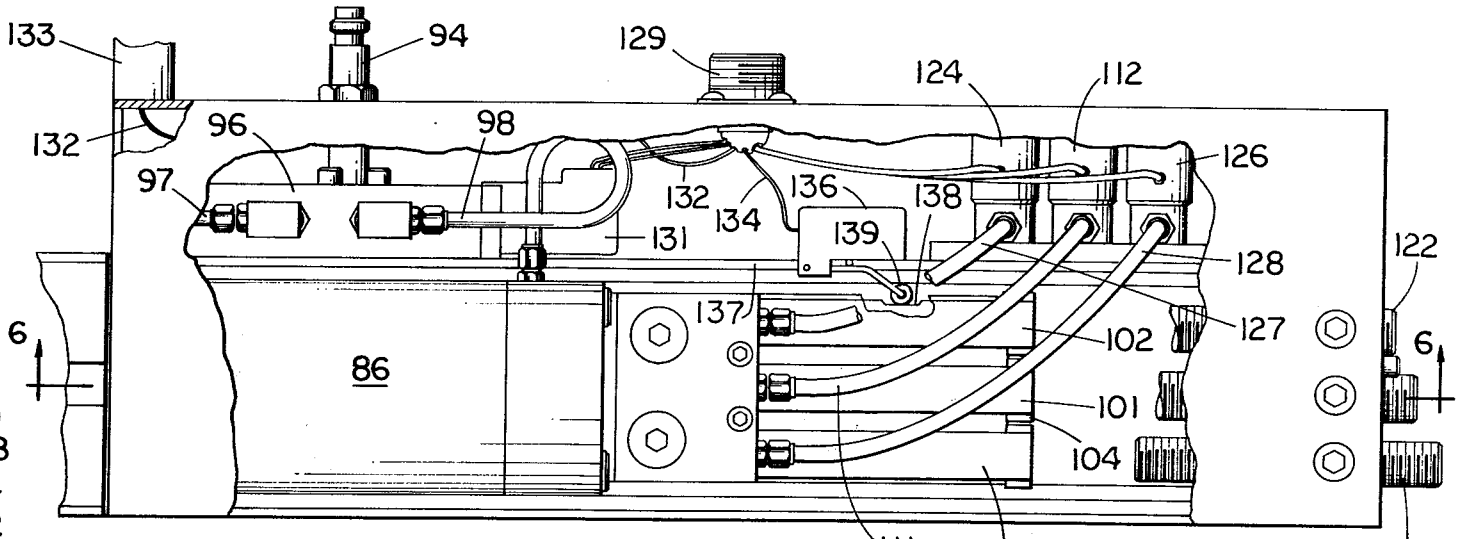
FIG. 5 is an enlarged top plan view showing the height changing drive actuator cylinder and stops.
Figure 6:
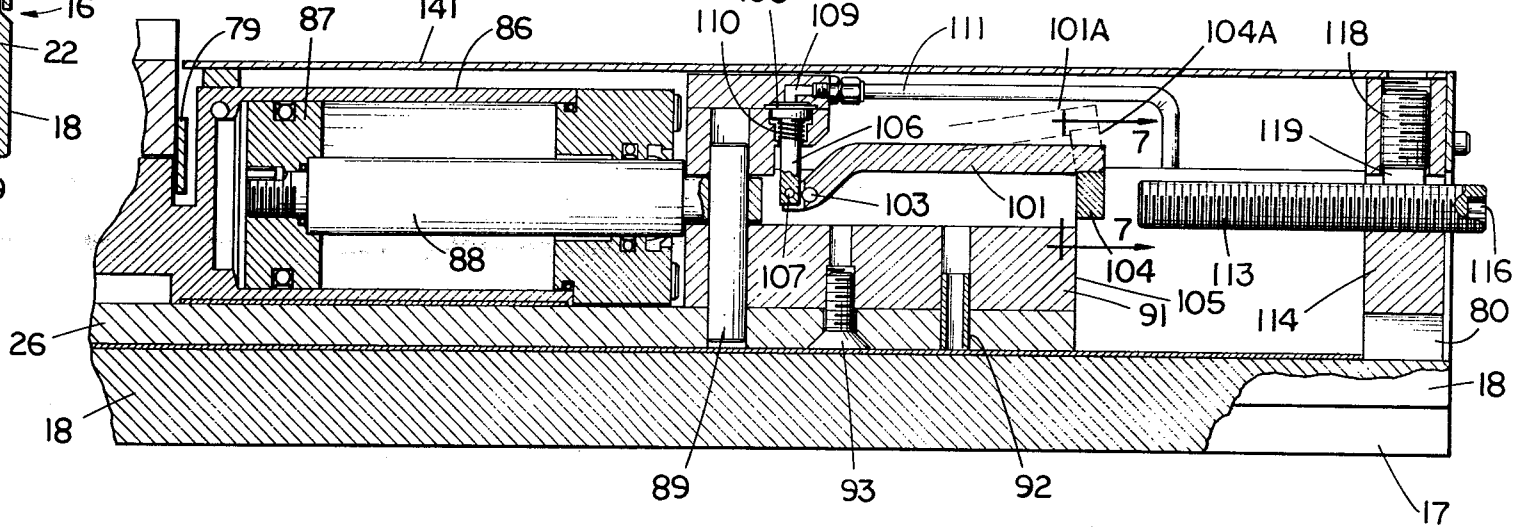
FIG. 6 is a section taken at line 6—6 in FIG. 5 and viewed in the direction of the arrows and showing the wedge drive actuator and stops.

As is best shown in FIG. 5, there are three stop fingers 99, 101, and 102. Each of these is pivotally mounted and air controlled. FIG. 6 is a section through finger 101 and shows that it is pivotally mounted to the stop housing 91 by pin 103. A stop bar 104 is affixed across the bottom of the right end of finger 101. A plunger 106 is connected to the left end of the finger by a pin 107.

Plunger 106 is urged upwardly by spring 110 against a diaphragm 108 below an air inlet 109 supplied by air line 111 from a three-way valve 112. When air is supplied over the diaphragm 108, it pushes the plunger down and tips the finger up to the position shown by the dotted line 101A.

An adjustable stop rod 113 is threadedly received in the stop mounting block 114 secured in the end of the frame 18. The stop rods have a hexagonal socket at 116 in the outer end, and a socket-head setscrew 118 bearing on a pad 119 bearing on the screw or rod secures the stop rod in place, once adjusted. Considering the solid line representation of the stop finger 101 and block 104, and the dotted line representation 101A and 104A, it will be seen that when air is supplied over the diaphragm 108, the finger and thereby the stop block 104A are raised out of alignment with the end of the stop rod 113. When pressure is not applied, the spring 110, together with the weight of the finger and stop bar will return it to the position shown in the drawings by the solid lines, whereupon the stop bar 104 is aligned with the end of the stop rod 113. Also the left face of bar 104 is flush with the right end 105 of stop housing 91 around the hole 140 provided in housing 91 to clear the stop 113 when the housing is driven to the right with the stop fingers up. This is shown in FIG. 7. When the bar is flush with the face 105 an abutment is thereby provided to stop travel of the housing to the right by abutment against the bar 104 abutting the stop rod 113. FIG. 5 shows that the fingers 99 and 102 also have stop bars locks affixed to the right-hand ends thereof, and these are aligned respectively with the stop rods 121 and 122. Each of these rods has a different adjustment, as shown by the fact that the ends thereof are different distances from the ends of the respective stop fingers.

Some additional details which may be noted in FIG. 5 are the solenoid operated air valves 124 and 126 for controlling air supply through lines 127 and 128, respectively, to the chambers above diaphragms for fingers 102 and 99, respectively, construction of these being the same as that illustrated and described above for finger 101. Also, there are conductors from the plug connector 129, these conductors leading to the solenoids for the three-way valves 112, 124, and 126, and also leads to the solenoid 131 for controlling the four-way valve 96. Also, there is an electrical cable 132 from a limit switch 133 and cable 134 from the wedge-down position indicator limit switch 136. Limit switch 136 is secured to a mounting wall 137 secured to the frame 18. A groove 138 is provided in the stop housing 91 or bar 26 to receive the operating roller 139 for the limit switch 136. The reception of the roller in this groove is used to indicate that the lower wedges and driver bar 26 have reached the limit of their travel in the left-hand direction. The limit switch 133, which is shown mounted to the cover plate 141 over the cylinder and stop assembly, merely for convenience in illustration, is operated by a block 142 mounted to the ram at the bottom of the stroke of the ram, to indicate when the bottom of the stroke has been reached.

Further referring to FIG. 1, a control unit 130 is provided having a source of electrical input indicated symbolically by the plug 143 and having an electrical cable 144 connected thereto from the plug 129 of the unit shown in FIG. 5. The housing or control box 130 has four selector switch units in a column 146, and to the right of each of those are thumbwheel switches. This is for the purpose of selecting which stop is to be used and how many times in sequence the stop is to be used before the next stop is used. This will become more apparent in the description of the operation. A block 147 in FIG. 1 symbolizes a source of shop air pressure to be supplied to the connector 94 in FIG. 5 for the valves 96, 112, 124 and 126.

A possible alternative drive for the lower wedges is a linear lead screw and drive motor therefor, with the motor control programmed to stop the motor as needed to properly locate the wedges for the various die heights desired, thus providing a virtually infinite number of stop positions within the range of total adjustment possible.

DESCRIPTION OF THE OPERATION

In the operation, the operator will adjust the various wedge adjusters 63 along the length of the adjustable die holder assembly to provide the amount of compensation needed for the bed deflection which may be expected for the run of work to be performed on the press brake. The operator will also adjust the switches 146 on the control box to select which of the adjustable stops will be used following the making of bends in the workpiece, depending upon the length of the various bends to be made. For each of the switches, he will adjust the thumbwheel switch to select the number of repetitions of the use of that stop for successive bends. He will do this for each of the switches 146. The adjustment of the respective stop rods will be made depending upon the difference in die heights or shut heights needed to bend the different lengths needed for the workpiece. The calibration of the rods may be such that one revolution of an adjustment rod on its axis will cause approximately 0.010 inches of vertical die height adjustments.

Then the workman starts making the bends in the workpiece. After each descent of the ram, the limit switch 133 signals the control 130 at the bottom of the ram's stroke, and the control signals the actuator cylinder control valve to shift the bar 26 fully to the left. Upon reaching the full left position, the wedge down position indicator limit switch is activated, which thereupon, by signalling the control 130, causes it to reverse the cylinder control valve 96, whereupon it starts the wedge drive to the right. At the same time, the control signals two or three of the valves 112, 124, and 126 to maintain air pressure on the diaphragms above the plungers for the stop fingers. In the event that one of the switches 146 has been moved to a position selecting one of the three stop fingers, then the controller, upon receipt of the signal from limit switch 136, will actuate the solenoid valve for that particular finger, releasing the air pressure therefrom and permitting the spring to return the finger to the stop position such as shown in FIG. 6, whereupon the travel of the wedge assembly to the right, effected by the air cylinder, will stop when the finger strikes the stop rod. At this point, the die height is established for the next bend, and the operator can proceed.

If the next subsequent bend is to be made with the die at the same height, it will be so indicated by the position of the cycle number thumbwheel switch for that particular stop and this will override the effect of the limit switch 133 at the end of descent of the ram on its next stroke, so the drive actuator will not be operated, and the finger will not be moved and the die will remain at the same height for the next bend. On the other hand, if only the one bend was to be made at that die height, then the control will automatically advance to the stop designated by another switch in group 146, whereupon the return of the wedge assembly to the right following full shift of the left, will stop when the stop finger controlled by that switch strikes the stop rod therefor at its particular setting. For one of the switches in the group 146, the drive to the right will terminate when the piston strikes the cylinder cap at the right-hand end, and that will determine the wedge height. The foregoing procedure will continue until the control has cycled through all of the stop switches which have been selected, and the number of cycles for each of those switches.

What is claimed is:

1. An adjustable die holder assembly for a press brake or the like comprising:

a die holder frame receivable on a press brake bed;

elongated die holder means mounted in said frame and having means thereon for holding a die therein;

and height changing means cooperating with said holder means and frame and operable, when actuated, to change the height of said holder means with respect to said frame uniformly throughout the length of said holder means, said holder means including a die holder bar; and said height changing means including a plurality of wedge means in said frame and vertically supporting said holder bar, said wedge means including upper wedges secured to said holder bar and a wedge driver mounted in said frame, said wedge driver being operable longitudinally of the holder bar and frame assembly to drive the wedges vertically as a unit.

2. The assembly of claim 1 wherein said wedge driver includes:

a powered actuator.

3. The assembly of claim 2 wherein:

said wedge driver includes a plurality of lower wedges connected to a wedge mounting and drive bar, said lower wedges supporting said upper wedges and said drive bar being connected to said actuator.

4. The assembly of claim 3 wherein:

said upper wedges are each connected to said die holder bar by connector means accommodating limited linear adjustment of a wedge longitudinally on said die holder bar, said combination further comprising individual wedge adjusters mounted in said die holder bar and engaging said upper wedges, there being at least one adjuster for each wedge, said one adjuster being adjustable independently of the adjusters for the others of said upper wedges, whereby various portions of the length of said holder bar are supportable at different heights with respect to said frame by differently positioning the upper wedges with respect to the lower wedges along the length of the assembly.

5. The assembly of claim 2 wherein said height changing means include:

a plurality of adjustable stop means cooperable with said wedge driver to limit the travel thereof imparted thereto by said actuator.

6. The assemply of claim 5 wherein said stop means include:

a plurality of adjustable stop rods; and a plurality of stop members, a different one of said members being associated with a different one of said rods, said members being individually operable to cooperate with the rod associated therewith to limit the drive of said driver in accordance with the position of said rod with respect to said driver.

7. The assembly of claim 6 wherein:

said wedges have inclined bearing surfaces facing downwardly;

said wedge drive includes a plurality of upwardly facing inclined surfaces, a different one of said upwardly facing surfaces supporting each different one of the upper wedges;

the inclination and surface friction between the inclined surface of the upper wedge and the surface of the wedge driver supporting it being such that downward loads in excess of a pre-determined maximum acceptable load will drive said wedge driver away from said stop rod to thereby release the excessive load from said assembly.

8. The assembly of claim 6 and further comprising:

a source of air pressure;

first valve means coupled to said source and to said actuator, said actuator including an air powered piston cylinder assembly, and said valve means being operable to selectively apply a pneumatic force to said piston to drive said wedge driver;

stop member control means including air operated control devices, a different one of said devices being connected to each different one of said stop member; and said devices being coupled through additional valve means to said source, said additional valve means being selectively operable to change the condition of one of said control devices independent of the others of said control devices, to individually operate the stop member connected to said one control device.

9. The assembly of claim 8 and further comprising:

limit switch means operable by said driver upon driving said holder bar to its lowest height with respect to said frame, and coupled to said first valve means to reverse said piston and coupled to said additional valve means to operate one of said stop members.

10. An adjustable die holder assembly for a press brake or the like comprising:

a die holder frame receivable on a press brake bed;

elongated die holder means mounted in said frame and having means thereon for holding a die therein;

height changing means cooperating with said holder means and frame and operable, when actuated, to change the height of said holder means with respect to said frame uniformly throughout the length of said holder means;

and compensating means cooperating with said holder means and frame and operable to change height of different portions of said holder means with respect to said frame by different amounts;

said compensating means including a plurality of height adjusters at spaced points along the length of said die holder means, said adjsters being individually adjustable to establish a crown of predetermined character in said holder means.

11. The assembly of claim 10 wherein said compensating means further include:

indicator means associated with each of said adjusters to indicate the adjusted condition of said adjusters.

12. The assembly of claim 10 wherein said compensating means further include:

individual die holder supporting members spaced along said die holder means and supported by said height changing means at different heights in accordance with the adjustment of a different one of said adjusters associated with each of said die holder supporting members.

13. In a press brake having a stationary frame, a reciprocable ram, a first die on said ram, and a second die the improvement comprising:

an adjustable die holder mounting said second die on said frame, said die holder being adjustable to change the height of said second die with respect to said first die;

and switch means coupled to said ram and to said holder and operable following completion of a die closing stroke of said ram to actuate said holder to change the height of said second die.

14. The improvement of claim 13 wherein said adjustable die holder includes:

cam means and a powered actuator therefor controlled by said switch means;

cam follower means engaging said cam means and supporting said lower die; and selectable stop means for said actuator to limit actuation of said cam means in response to control by said switch means.

15. The improvement of claim 14 wherein:

said selectable stop means include a plurality of selectable stop means each being controlled by said switch means.

16. The improvement of claim 15 wherein said switch means include:

a first switch operable immediately following completion of a die closing stroke to initiate movement of said actuator in one direction;

a second switch coupled to said actuator and operable thereby upon attainment of a predetermined extent of travel in said one direction to thereupon reverse said actuator;

and additional switches, one for each of said stop members and coupled to said second switch for actuation thereby when said second switch reverses said actuator.

17. The improvement of claim 16 and further comprising:

a plurality of individual height adjustment means along said die holder for providing different spacing between portions of said first and second dies when said dies are separated at the completion of a ram opening stroke.

18. The improvement of claim 17 wherein:

said cam follower means include a plurality of cam followers, and said height adjustment means include an individual follower adjusting member for each follower, said adjusting member having adjustment condition indicator means thereon.

19. The improvement of claim 14 wherein:

said cam means include a bar with a plurality of cam ramps spaced therealong; and said cam follower means include a plurality of follower members having inclined faces supported on said ramps and slideable therealong as said bar is moved linearly by said actuator in a direction parallel to the length of said second die, and said follower members are confined to move vertically in response to sliding of said follower members up and down on said ramps.

20. The improvement of claim 19 wherein:

said actuator is an air piston, and the inclination of said ramps and faces is sufficiently flat to support normal loading of said second die by said ram during closure of said first and second dies on a workpiece but sufficiently steep to displace said ramps and bar against the force of said air piston.

21. The improvement of claim 20 wherein:

said bar has an end portion extending beyond said die holder whenever said second die is at any height greater than its minimum and said end portion being exposed for access and susceptible to respond to an endwise blow from an external source to move linearly and permit descent of said ramps by said follower members, and corresponding descent of said second die, for release of a stuck press brake.

* * * * *